US008453303B1

(12) United States Patent
Gamertsfelder et al.

(10) Patent No.: US 8,453,303 B1
(45) Date of Patent: Jun. 4, 2013

(54) HEART PET BURIAL VAULT

(76) Inventors: Patricia Ellen Gamertsfelder, Hartville, OH (US); Allen Martin Gamertsfelder, Hartville, OH (US)

( * ) Notice: Subject to any disclaimer, the term of this patent is extended or adjusted under 35 U.S.C. 154(b) by 0 days.

(21) Appl. No.: 13/507,407

(22) Filed: Jun. 26, 2012

(51) Int. Cl.
*A61G 17/00* (2006.01)

(52) U.S. Cl.
USPC ..... 27/17; 27/2; 27/7; 220/327

(58) Field of Classification Search
USPC ..... 27/1, 2, 7, 35, DIG. 1, 14, 17; 52/128, 52/138–140; 119/496, 497; 220/327, 378; 285/901
See application file for complete search history.

(56) References Cited

U.S. PATENT DOCUMENTS 3,490,417 A * 1/1970 Swinney ..... 119/496
3,666,340 A * 5/1972 Albeanese ..... 312/283
3,688,941 A * 9/1972 Bildsten ..... 220/327
4,233,697 A * 11/1980 Cornwall ..... 4/252.4
5,031,573 A * 7/1991 De Marco et al. ..... 119/496
5,282,439 A * 2/1994 Oaks ..... 119/482
5,341,548 A * 8/1994 Zerick ..... 27/28
5,471,950 A * 12/1995 White ..... 119/497
5,560,511 A * 10/1996 McNerney ..... 220/327
5,659,932 A * 8/1997 Wright ..... 27/7
6,052,877 A * 4/2000 Richard ..... 27/1
6,574,840 B1 * 6/2003 Doppel ..... 27/2
2005/0125973 A1 * 6/2005 Hankel et al. ..... 27/1

* cited by examiner

*Primary Examiner* — William L. Miller

(57) ABSTRACT

Through experience of extended travels it is quite apparent that there is a need to solve the perplexing question of what should a person do when a family pet dies while on vacation. The Heart Pet Burial Vault solves this problem for owners of small to medium pets who die while miles from home and wish to return their pets home for burial. The burial vault is a strong, solid enclosure that protects the pet carcass inside an encasement that seals itself through a easy closing of an end cap by the simple turning of two screws. The unique seal allows the pet owner to retain the pet carcass for an extended period of time to store, transport and bury all in the same container without the fear of odor or liquid seepage.

1 Claim, 3 Drawing Sheets

HEART PET BURIAL VAULT

CROSS-REFERENCE TO RELATED APPLICATIONS

Not Applicable

BACKGROUND OF THE INVENTION

Figure 1:
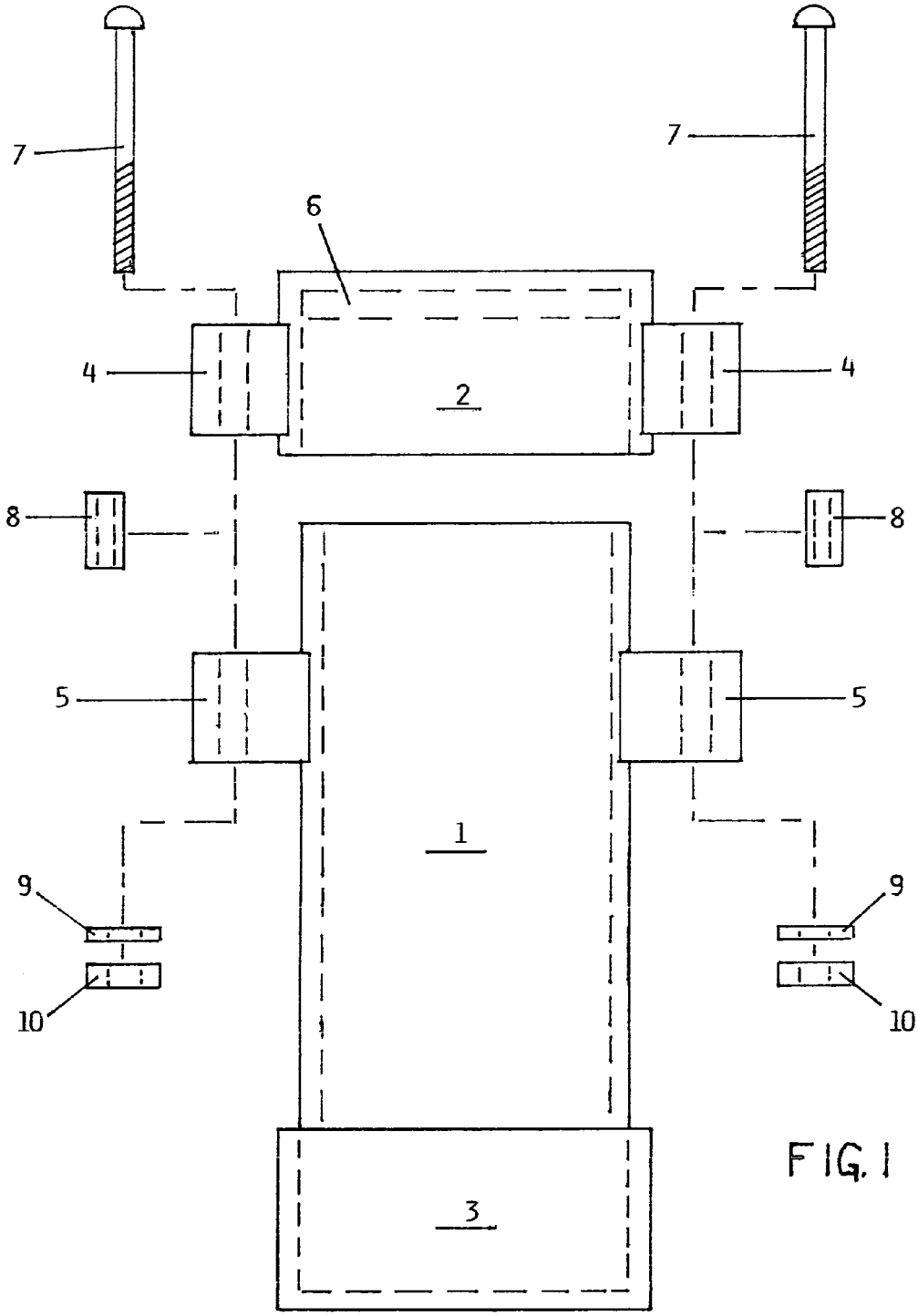

Through experience, my wife and I have witnessed the death of a pet dog while on an extended vacation over a thousand miles from our home and were faced with the possibility of not being able to return home for a home site burial for our pet. One experience of attempting to wrap our deceased pet in plastic neither sealed off the gases of the foul odor nor the fluid excreting from the carcass which occurred in just a few days. The second attempt of enclosure was 100% successful. I acquired a suitable size piece of plastic pipe, PVC (poly vinyl chloride), two end caps and with the proper adhesive was able to seal our pet inside the encasement with no odor nor fluid seepage.

I found that sealing the second end cap to complete the encasement was very difficult as the air pressure built inside the pipe made it an extremely difficult task to push on the cap and complete the seal. The average person with little or no experience in the field of plumbing would face a near impossible task to achieve a like encasement.

After several years of experimenting with various types of pipe, plastics, adhesives, rubber, foam and extensive time spent on a process to simplify a procedure for sealing of the enclosure, I have developed a vault that a deceased pet or animal of a small to medium size can be enclosed for an extended period of time that can be stored, transported, and buried in the same encasement. The animal can be held for an extended period of time in a location miles from the site of burial of the pet or animal with out the fear of gases, odor or fluids escaping from the sealed pet burial vault.

BRIEF SUMMARY OF THE INVENTION

This vault has a unique closing system that can be preformed by any person who has the slightest ability to turn the handle of a screwdriver to complete the seal of the Heart Pet Burial Vault. There is no need of mechanical skill or skill or knowledge in the use of PVC adhesives.

After a deceased pet or animal is placed in the burial vault, a food grade grease (supplied) would be applied to two or three inches of the open end of the outside wall of the vault body and to the inside wall of the closing cap. The food grade grease will facilitate an easy start to slide the closing cap onto the vault body while lining up the two closing ears located on either side of the vault body with the closing ears located on either side of the closing cap. The airtight seal of the pet burial vault is accomplished by applying a screw driver to the two screws that are located on either side of the vault. The two screws turn into the nuts on either side of the vault which have the closing ears adhered to the vault body and to the closing cap. The action will draw the open end of the vault body and the closing cap together in such a manner that the vault end will be embedded in a circle of butyl rubber self adhesive ring inside the bottom of the closing cap.

The closing ears are adhered in a position on either side of both the vault and the closing cap which will allow the user to finish the procedure of sealing the vault body into the butyl rubber self adhesive ring located inside the bottom of the closing cap with the final tightening of the two screws.

BRIEF DESCRIPTION OF THE SEVERAL VIEWS OF DRAWINGS

There are 3 sheets of drawings, and 5 FIG. views.

Drawing on sheet 1/3 FIG. 1 Shows all parts and components of the Burial Vault container which is made of all PVC components. It also includes two short vinyl tube temporary separators, two 3 inch, #10-24 machine screws, two #10 flat washers and two #10-24 machine screw nuts.

Figure 2:
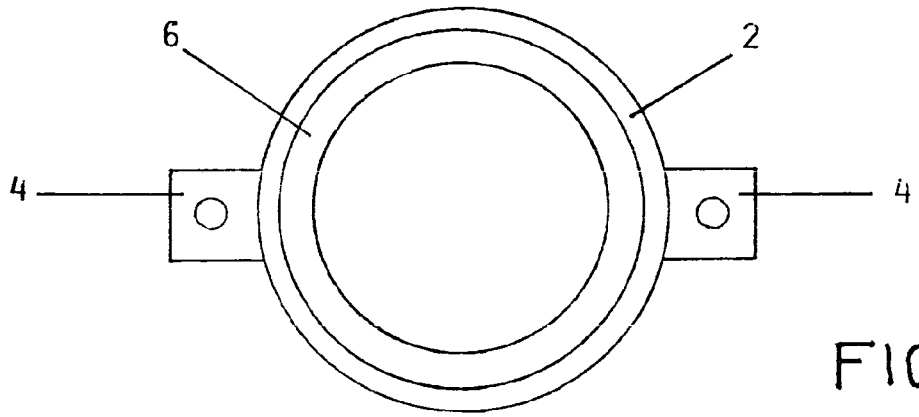

Drawing on sheet 2/3 of FIG. 2 Shows view of closing cap looking in to the open end of the closing cap to the rear of the closing cap where the butyl rubber self adhesive ring is located, the view also shows the location of the concave shape of the two closing ears adhered to the closing cap.

Figure 3:
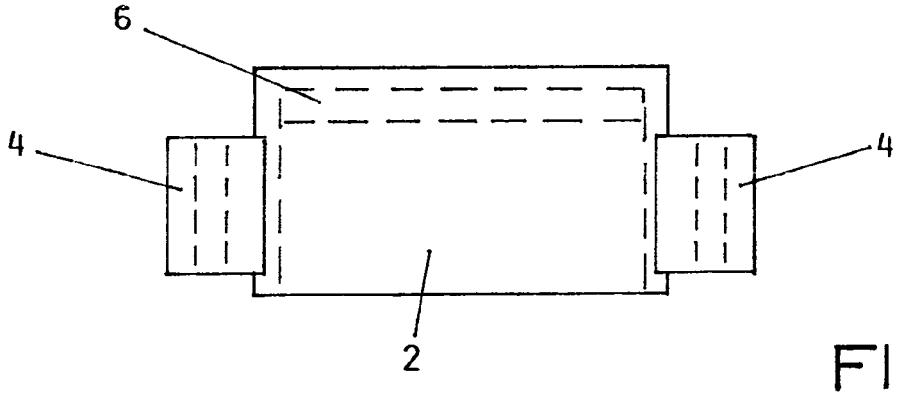

Drawing on sheet 2/3 of FIG. 3 Shows a side view of the closing cap, closing ears and the location of the butyl rubber self adhesive ring.

Figure 4:
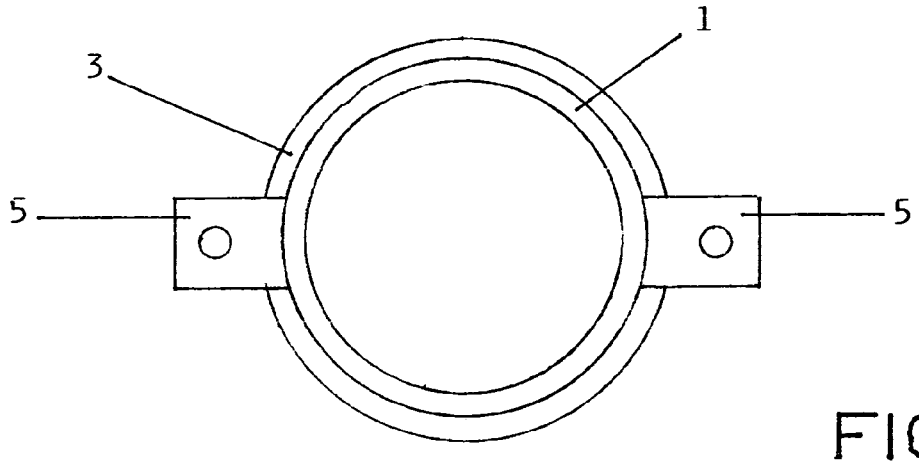

Drawing on sheet 2/3 of FIG. 4 Shows view of the open end of the vault body; the outer circle is the permanently sealed end cap at the distal end of the vault body and also shows the location of the concave shape of the two closing ears adhered to the vault body.

Figure 5:
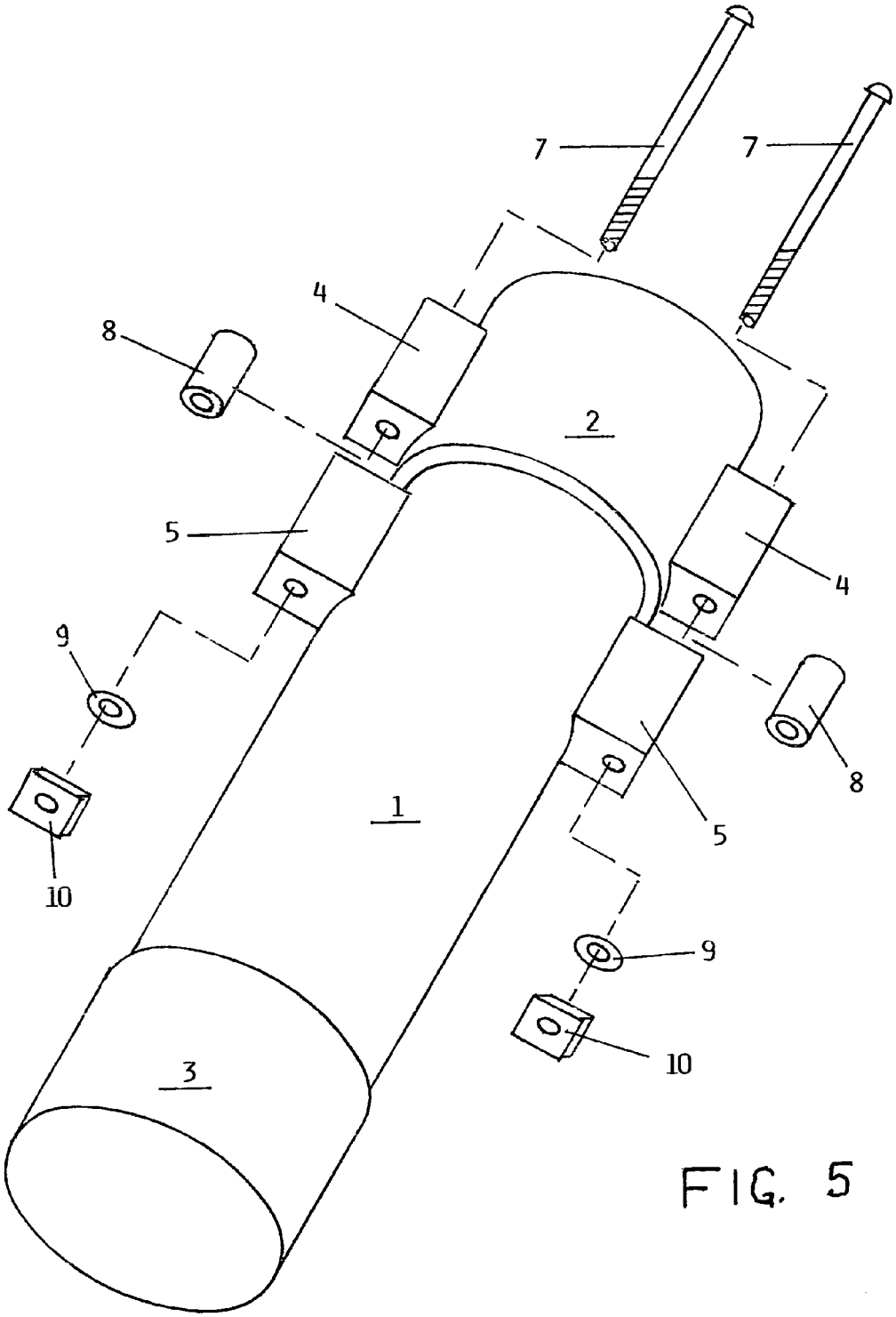

Drawing on sheet 3/3 of FIG. 5 Shows a cylindrical shape of the burial vault as the burial vault would appear to be assembled with a would be carcass inside, the two vinyl separators are removed and discarded so that the closing cap and the vault body can be brought together and tightened with the screws and nuts to draw the vault body end into the butyl rubber self adhesive ring inside the closing cap.

DETAILED DESCRIPTION OF THE INVENTION

The pet burial vault is a PVC (poly-vinyl-chloride) cylinder which is of 4 inch, or 6 inch, or 8 inch in diameter with two attached PVC caps matched to fit the same size pipe. One cap is designated as the distal end cap and is permanently attached with a air tight primer and bonding glue, the top cap is designated as the closing cap. Each complete vault has two ears adhered to the closing cap and two ears adhered to the vault body for the purpose of drawing the vault body into the open end of the closing cap when the closing ears are drawn together by the 3 inch screws to allow the vault body open end to imbed itself into the butyl rubber self adhesive ring inside the bottom of the closing cap to complete the vault container seal.

REFERENCE NUMBERS TO THE 3 SHEET DRAWINGS

1. Vault body
2. Closing end cap
3. End cap permanently sealed
4. Closing ears on closing cap
5. Closing ears on vault body
6. Butyl rubber self adhesive ring
7. Screws, 3 inch #10-24 steel round head
8. Vinyl tube separators, used in FIG. 1 only to keep ears apart In FIG. 5 Vinyl tube separators, discarded to allow closing of ears
9. Washers SAE #10 steel
10. Machine screw nuts SAE #10-24

What is claimed is:

1. A burial vault container for extended storage, transportation, and burial of a deceased pet, comprising:

a cylindrical vault body made of PVC for receiving said deceased pet therein, said vault body having a distal end and an opposing top end, said vault body having two closing ears located on opposite sides of a periphery thereof adjacent said top end, each ear having a through-hole;

a distal end cap made of PVC permanently sealed to said distal end with a primer and bonding glue;

a closing cap made of PVC attached to said top end, said closing cap having a butyl rubber self-adhesive ring disposed therein, said closing cap having two closing ears located on opposite sides of a periphery thereof, each ear having a throughhole alignable with said throughhole of said respective ear of said vault body;

a fastener assembly including a screw passing through each of said aligned throughholes of said respective ears and a cooperating washer nut assembly such that as said fastener assembly is tightened, said closing cap and its ears are drawn towards said vault body and its ears such that said top end of said vault body embeds itself into said butyl rubber self-adhesive ring thereby creating an airtight seal to prevent odor and liquid seepage.

* * * * *